United States Patent [19]

Archer

[11] 4,176,874

[45] Dec. 4, 1979

[54] LIFTING RINGS FOR CHAIN SLINGS

[75] Inventor: Jean F. Archer, Villennes, France

[73] Assignee: Stas Societe Technique d'Accessoires Specialises, Sartrouville, France

[21] Appl. No.: 922,509

[22] Filed: Jul. 6, 1978

[30] Foreign Application Priority Data

Jul. 7, 1977 [FR] France ..... 77 21841

[51] Int. Cl.[2] ..... B66C 1/12

[52] U.S. Cl. ..... 294/78 A; 24/116 R; 59/93; 294/74

[58] Field of Search ..... 294/74, 78 R, 78 A, 294/82 R; 24/116 R, 116 A, 128, 129 R, 129 A, 129 B, 230.5 R; 59/93

[56] References Cited

U.S. PATENT DOCUMENTS

| | | | |
|---|---|---|---|
| 569,448 | 10/1896 | Dudley | 294/82 R |
| 1,656,676 | 1/1928 | Mills | 294/74 X |
| 2,669,761 | 2/1954 | Hower et al. | 294/74 X |
| 4,060,269 | 11/1977 | Rieger et al. | 294/78 A |

FOREIGN PATENT DOCUMENTS

| | | | |
|---|---|---|---|
| 1404546 | 5/1965 | France | 294/78 A |
| 576909 | 6/1976 | Switzerland | 294/74 |

*Primary Examiner*—Johnny D. Cherry
*Attorney, Agent, or Firm*—Karl F. Ross

[57] ABSTRACT

A lifting ring for a chain sling comprises two generally L-shaped lugs, located on opposite sides of the central plane of the ring body. The upright limbs of the lugs extend partly along the respective sides of the ring body and the lower limbs of the lugs extend partly along the lower side of the ring body towards the central plane. Each lug is provided with an opening of such size and configuration that a chain link can pass through the opening, the width of the opening being less than the width of a chain link whereby withdrawal of the link from the opening when the chain is under tension is prevented by the adjacent link at right angles thereto.

1 Claim, 3 Drawing Figures

LIFTING RINGS FOR CHAIN SLINGS

BACKGROUND OF THE INVENTION

1. Field of the Invention

The present invention relates to lifting rings for chain slings.

2. Description of the Prior Art

It is possible to alter the length of a chain sling by hooking a link of the chain to the lifting hook, in such a manner as to form a loop. Use may be made, for this purpose, of hooks whose nose is parallel with the hook body. However, the chain link which is engaged and held in the opening of the hook is disposed obliquely relatively to the strand of the sling which extends it; this link is thus subjected not to tension but to a bending stress in such a manner that this link operates under adverse conditions and constitutes a weak point of the sling; the breaking strength of the latter is substantially decreased.

SUMMARY OF THE INVENTION

According to the invention there is provided a lifting ring for a chain sling, said ring comprising a body having side portions and a bottom portion, two lugs rigid with the body, each lug having means defining an elongate opening whose width is greater than the thickness of the chain links, but smaller than their width and terminating at the top in an opening of greater width than that of the said links, said lugs being perpendicular to the plane of the body and being bent in such a manner as to extend partly over the side portions of the body and partly over the bottom portion of the body, the bottom portion of the said lugs being directed towards the central plane of the ring.

BRIEF DESCRIPTION OF THE DRAWINGS

An embodiment of the invention, will now be described, by way of example only, with reference to the accompanying diagrammatic drawings, in which.

DESCRIPTION OF THE PREFERRED EMBODIMENTS

Figure 3:
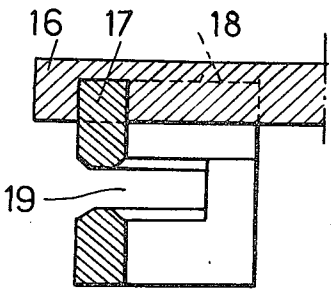
FIG.3 is a cross-section taken on line III—III of FIG. 1.
Figure 2:
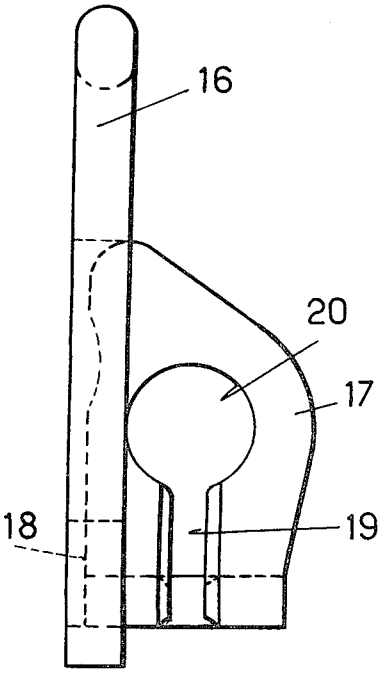
FIG. 2 is a side elevation of the ring.

As shown in the drawing, the body 16 of a lifting ring has, when viewed from the front, a substantially rectangular shape. Two lug-forming pieces 17 are inserted and welded in notches 18 of the ring body 16. The pieces 17 are each bent through about 90° with a rounded angle, one end of each piece being directed vertically upwards, and the other end being directed horizontally towards the central plane of the ring.

Each of the pieces 17 has an elongate opening 19 which extends on both sides of the bend of the piece and whose edges are, preferably, chamfered. The opening 19 has a width greater than the thickness of the links of the chain 12 for which the ring is intended, but smaller than their width. In the upper part of the piece 17, the opening 19 extends into a circular opening 20, whose diameter is at least equal to the width of the links of the chain 12.

Figure 1:
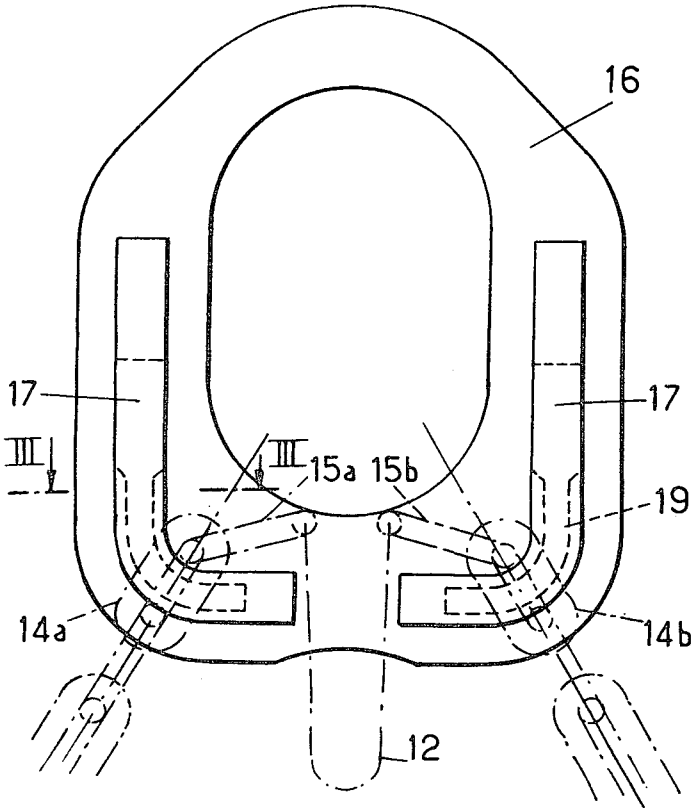
FIG. 1 is a front elevation of a lifting ring in accordance with the invention.

To use the lifting ring, the chain 12 is passed into the openings 20 of the pieces 17 and then, two links **14*a* and 14*b* which are parallel with the plane of the ring body 16 are engaged in the openings 19; these links are prevented from coming out of the openings 19 by the adjacent links 15*a* and 15*b* which are perpendicular to the ring body. It will be seen in FIG. 1 that the links 14*a* and 14*b* operate exclusively in tension so that they can carry, without danger, the load for which chain 12** is intended.

What is claimed is:

1. A lifting ring for a chain sling, said ring comprising a body having side portions and a bottom portion, two lugs rigid with the body, each lug having means defining an elongate opening whose width is greater than the thickness of the chain links, but smaller than their width and terminating at the top in an opening of greater width than that of the said links, said lugs being perpendicular to the plane of the body and being bent in such a manner as to extend partly over the side portions of the body and partly over the bottom portion of the body, the bottom portion of the said lugs being directed towards the central plane of the ring.

* * * * *